US012084254B2

(12) United States Patent
Buhl

(10) Patent No.: US 12,084,254 B2
(45) Date of Patent: Sep. 10, 2024

(54) PACKAGE CUSHIONING FOR AN ARTICLE TO BE PACKAGED

(71) Applicant: Buhl-PaperForm GmbH, Burbach (DE)

(72) Inventor: Christoph Buhl, Neunkirchen (DE)

(73) Assignee: Buhl-PaperForm GmbH, Burbach (DE)

( * ) Notice: Subject to any disclaimer, the term of this patent is extended or adjusted under 35 U.S.C. 154(b) by 8 days.

(21) Appl. No.: 18/067,772

(22) Filed: Dec. 19, 2022

(65) Prior Publication Data

US 2023/0192383 A1 Jun. 22, 2023

(30) Foreign Application Priority Data

Dec. 21, 2021 (DE) ..... 10 2021 134 047.0
Mar. 9, 2022 (DE) ..... 10 2022 105 515.9

(51) Int. Cl.
*B65D 81/05* (2006.01)

(52) U.S. Cl.
CPC ..... *B65D 81/053* (2013.01)

(58) Field of Classification Search
CPC .. B65D 81/053; B65D 81/055; B65D 81/054; B65D 81/05; B65D 81/107; B65D 81/133; B65D 81/127
USPC ..... 206/586, 521, 418, 419
See application file for complete search history.

(56) References Cited

U.S. PATENT DOCUMENTS 3,762,626 A * 10/1973 Dorsey ..... B65D 81/056 206/326
4,120,441 A * 10/1978 Hurley ..... B65D 5/5088 217/69
5,016,751 A 5/1991 Creaden
5,569,519 A * 10/1996 Ervay ..... D04H 1/425 428/156
5,769,233 A * 6/1998 Fredriks ..... B65D 81/054 206/320
6,123,199 A 9/2000 Madsen
2003/0070951 A1* 4/2003 Hurley ..... B65D 81/133 206/427
2003/0080023 A1* 5/2003 Slot ..... B65D 81/133 206/588

(Continued)

FOREIGN PATENT DOCUMENTS

CN 201457982 U 5/2010
CN 201634076 U 11/2010

(Continued)

*Primary Examiner* — Steven A. Reynolds
(74) *Attorney, Agent, or Firm* — Smartpat PLC

(57) ABSTRACT

A package cushioning for padding an article to be packaged in an outer box includes a base body in the form of a downwardly open half tube. On the outside thereof are attached opposing hump-shaped support members, which protrude beyond the half-tube on the upper side of the base body. Opposing surfaces of the support members and their transitions each form an upwardly open channel section on the package cushioning. The entire package cushioning is made in one piece with an average wall thickness W from a waste paper fiber material. A low point on the inside of the upwardly open channel section is spaced by the distance from the high point on the inside of the downwardly open half tube, the distance being greater than the simple wall thickness.

22 Claims, 15 Drawing Sheets

(56) References Cited

U.S. PATENT DOCUMENTS

| | | | | |
|---|---|---|---|---|
| 2005/0074585 | A1* | 4/2005 | Hsieh | B65D 81/133 428/119 |
| 2007/0138047 | A1* | 6/2007 | Berglin | B65D 81/025 206/521 |
| 2007/0214750 | A1* | 9/2007 | Malone | B65D 81/053 53/474 |
| 2008/0169216 | A1* | 7/2008 | Kaltz | B65D 21/0212 206/507 |
| 2013/0092585 | A1 | 4/2013 | Ramirez et al. | |
| 2014/0061088 | A1* | 3/2014 | Nakamura | B65D 5/5069 206/521 |
| 2016/0229621 | A1* | 8/2016 | Jiang | B65D 81/113 |
| 2019/0100347 | A1* | 4/2019 | Carrier | B65D 5/48026 |

FOREIGN PATENT DOCUMENTS

| | | | |
|---|---|---|---|
| CN | 107128602 | A | 9/2017 |
| EP | 0844196 | B1 | 5/2003 |
| GB | 2349870 | A | 11/2000 |
| TW | 523483 | B | 3/2003 |

* cited by examiner

III-III

100`, 100

PACKAGE CUSHIONING FOR AN ARTICLE TO BE PACKAGED

CROSS-REFERENCE TO RELATED APPLICATIONS

This application claims the benefit of German Patent Applications No. 10 2021 134 047.0, filed 2021 Dec. 21, and No. 10 2022 105 515.9, filed 2022 Mar. 9, the contents of which are hereby incorporated by reference in their entireties.

TECHNICAL FIELD

The disclosure relates to a package cushioning for padding an article to be packaged in an outer box.

BACKGROUND

Package cushioning is used to protect articles during shipment. Vibration and impact shock during shipment and loading/unloading are controlled by cushioning to reduce the chance of product damage.

Cushioning is usually inside a shipping container such as a corrugated box. It is designed to absorb shock by crushing and deforming, and to dampen vibration, rather than transmitting the shock and vibration to the protected article.

Internal packaging materials are also used for functions other than cushioning, such as to immobilize the products in the box and lock them in place, or to fill a void.

SUMMARY

A package cushioning comprises at least one base member, which is structured as follows: It comprises a base body in the form of a downwardly open half tube and at least two hump-shaped support members that are arranged on the outside of the half-tube, visibly facing each other there, and protrude on the outside of the base body with a height H above the high point on the inside of the downwardly open half tube. The opposing surfaces of the hump-shaped support members and their transition to one another on the outside of the downwardly open half tube are shaped in such a way that they jointly form an upwardly open channel section. The entire package cushioning, in particular each of the base members, is made in one piece with an average wall thickness from a waste paper fiber material.

The disclosure is based on the object of improving a known package cushioning, and a packaging with an outer box and said package cushioning, such that the rigidity of the package cushioning in a direction transverse to its longitudinal axis is increased.

This object is achieved by the subject matter as claimed. Accordingly, the low point on the inside of the upwardly open channel section is spaced by the distance h with h>the simple wall thickness of the package cushioning or the base member from the high point H1 on the inside of the downwardly open half tube open.

The disclosed design of the distance h offers the advantage that it significantly increases the rigidity of the base member and possibly also that of the package cushioning, in particular in a direction transverse to its longitudinal axis L. Furthermore, the package cushioning is no more expensive than expandable polystyrene (EPS), but in contrast to EPS it can be recycled because it is made from waste paper.

According to a first exemplary embodiment, this rigidity is particularly good or large when the distance h is greater than or equal to twice the wall thickness. At the same time, care should preferably be taken to ensure that the distance h is not selected to be greater than the height H, in order to ensure that the transition between the opposing support members does not exceed the support members themselves in terms of their height H above the high point H1.

Such a base member can generally be of any length, with the length preferably being adapted to the length of the article to be packaged.

The terms "down", "up", "downwardly" and "upwardly" and accordingly the terms "lower side" and "upper side" refer to the spatial arrangement of the package cushioning or base member shown in FIG. 1. What can be seen in FIG. 3 in a plan view of the base member forms its upper side. Only a few areas of the lower side of the base member can be seen in FIG. 1, insofar as they can be seen through the cut-open hollow support members. FIG. 2 shows the lower side of the package cushioning as in FIG. 1.

The object of the disclosure is further achieved by a packaging for the article to be packaged, this packaging having an outer box and at least one package cushioning inserted on the inside of the outer box on its bottom for defining and delimiting a receiving space for the article to be packaged within the outer box. The advantages of this solution to the problem correspond to the advantages mentioned above in relation to the package cushioning.

Advantageous configurations of the package cushioning and the packaging are the subject matter of the dependent claims and can be combined with one another as far as technically feasible.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

The invention is described in detail below with reference to the figures mentioned in the form of exemplary embodiments. Technical elements are denoted by the same reference symbols in all figures.

Figure 1:
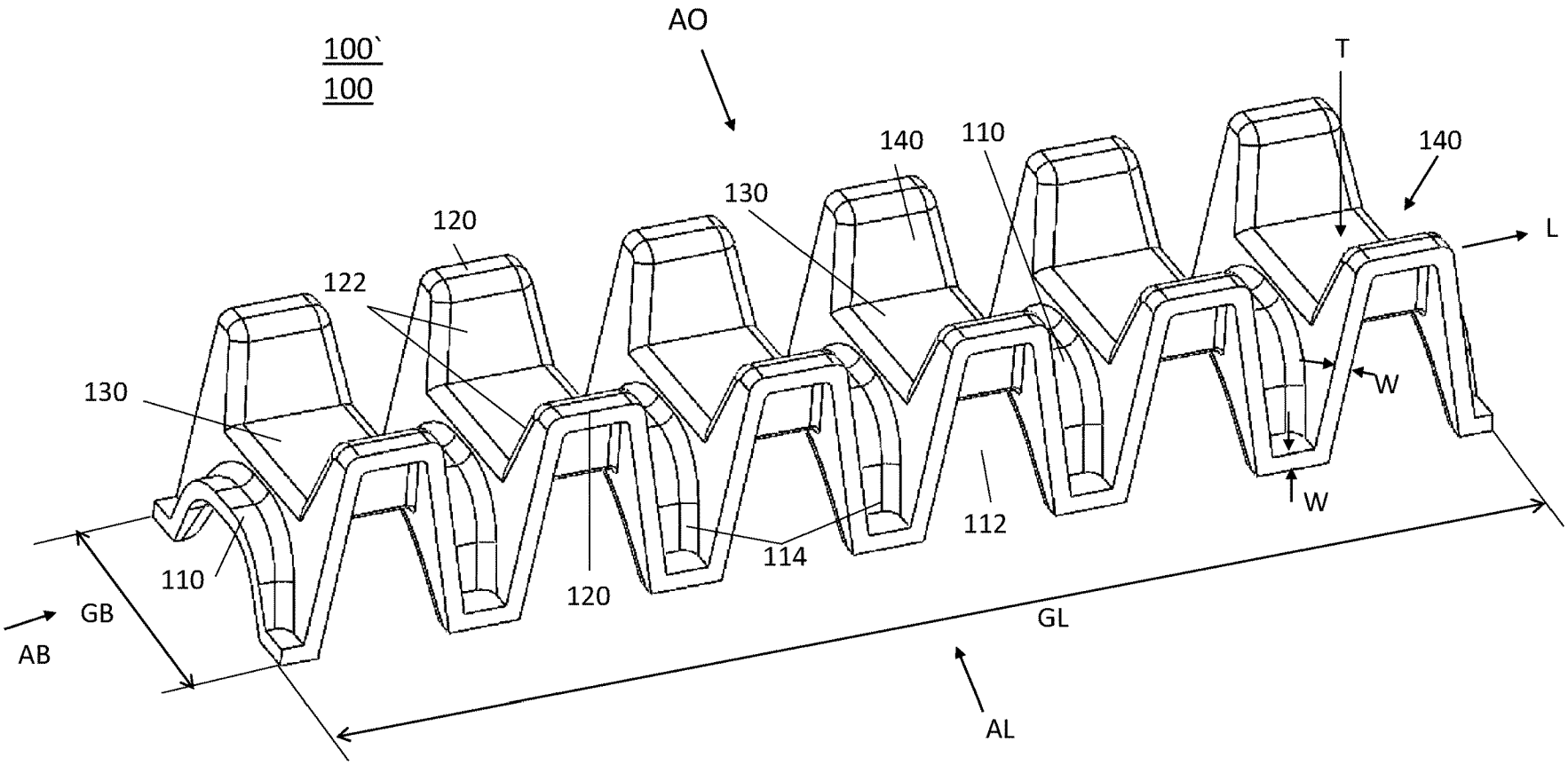
FIG. 1 is a perspective upper side, longitudinal side and front view showing a first embodiment of a base member of a package cushioning.

FIG. 1 shows a package cushioning 100' for padding an article to be packaged in an outer box, with the package cushioning here comprising only one base member 100. The base member 100 has a base body in the form of a downwardly open half tube 110, on the outside of which hump-shaped support members 120 are attached. The hump-shaped support members 120 are in pairs opposite one another and project upwardly beyond the downwardly open half-tube 110. A transition 130 is formed between the opposing surfaces 122 of the hump-shaped support members 120. Together with the opposing surfaces 122 of the support members 120 the transition 130 forms an upwardly open channel section 140. A plurality of these pairs of support members are arranged next to one another at preferably equidistant distances a along the longitudinal axis L of the downwardly open half tube. The entire package cushioning shown in FIG. 1, i.e. here the one base member 100, is made in one piece with an average wall thickness W from a waste paper fiber material. In FIG. 1, the total width GB and the total length GL of the package cushioning of the base member are also shown. Finally, the low point T on the inside of the upwardly open channel section 140 can also be seen. The viewing directions or views of the face, the longitudinal side and the upper side are marked with the arrows AB, AL and A0.

The support members 120 are each designed as hollow bodies and the wall of the downwardly open half tube is open in the area of the hollow support members. Thereby, the downwardly open half tube and the support members span a common downwardly open cavity 112. The downwardly open cavity 112 is delimited by the remaining unbroken wall sections 114 of the downwardly open half tube, which face each other in pairs. The design as a hollow body offers the advantage of weight savings and the stackability of the base members.

Figure 2:
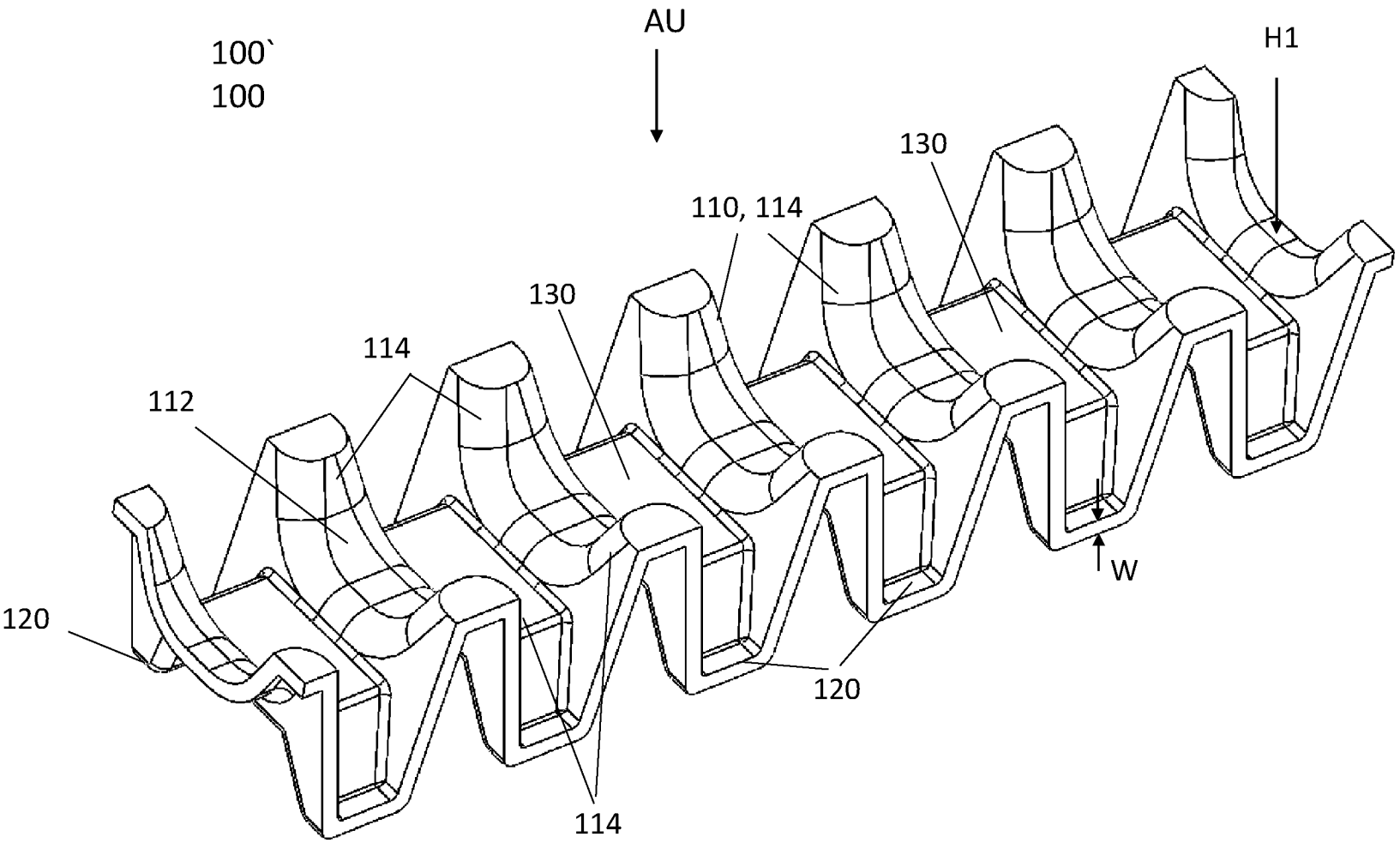
FIG. 2 is a perspective lower side view of the base member of FIG. 1.

FIG. 2 shows the base member in its first embodiment according to FIG. 1 in a perspective lower side view. After the formation of the hollow support members 120, only the said wall sections 114 remain of the original half tube. The individual wall sections 114 are arranged in pairs opposite one another and are spaced apart in the longitudinal direction by the transitions 130 of the support members 120 opposite one another. In addition to the wall thickness W, a high point H1 on the inside of the half tube 110 can also be seen in FIG. 2. In the "normal view" according to FIG. 1, the high point H1 represents the apex; in the lower side view according to FIG. 2, the apex H1 logically symbolizes a low point of the downwardly open half tube 110.

Figure 3D:
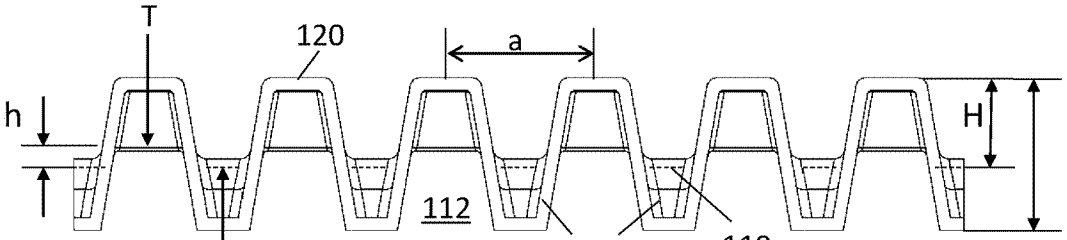
FIG. 3*d* is a cross sectional view through the base member along the longitudinal axis L-L of FIG. 3*a;*
Figure 3C:
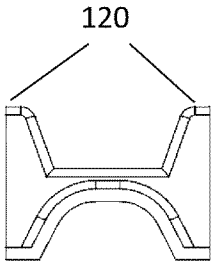
FIG. 3*c* shows an end face of the base member as in FIGS. 1 and 2.
Figure 3A:
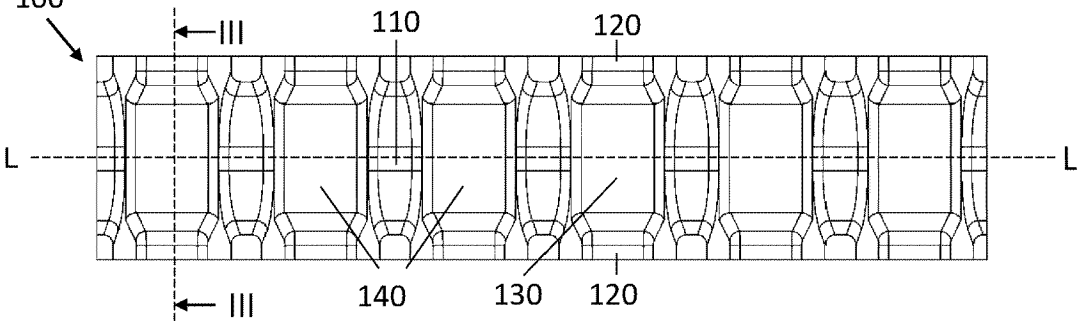
FIG. 3*a* is an upper side view of the base member according to FIGS. 1 and 2.
Figure 3B:
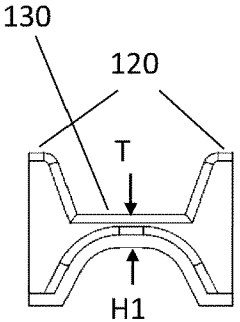
FIG. 3*b* is a cross-sectional view at point III-III of FIG. 3*a;*

FIG. 3*a* illustrates an upper side view of the base member 100 of FIG. 1. FIG. 3*b* shows a cross section through the base member along line III-III of FIG. 3*a*. FIG. 3*c* shows an end face of the base member. FIG. 3*d* shows a cross section through the base member along the longitudinal axis L. In addition to the high point H1, which corresponds to the apex on the inside of the downwardly open half tube 110, this sectional view also shows the low point T of the upwardly open channel section 140. A vertical distance h between the high point H1 and the low point T is also illustrated. This vertical distance h is greater than the simple wall thickness W. Preferably vertical distance h is selected to be greater than or equal to twice the wall thickness W in order to sufficiently stabilize the package cushioning in a direction transverse to its longitudinal axis L for possible impact loads. In addition to the vertical distance h, the total height GH of the base member and the height H of the individual support member above the high point H1 are also illustrated. Finally, the mentioned sectional view shows the distance a between adjacent pairs of the hump-shaped support members in the longitudinal direction L of the base member 100.

Figure 4:
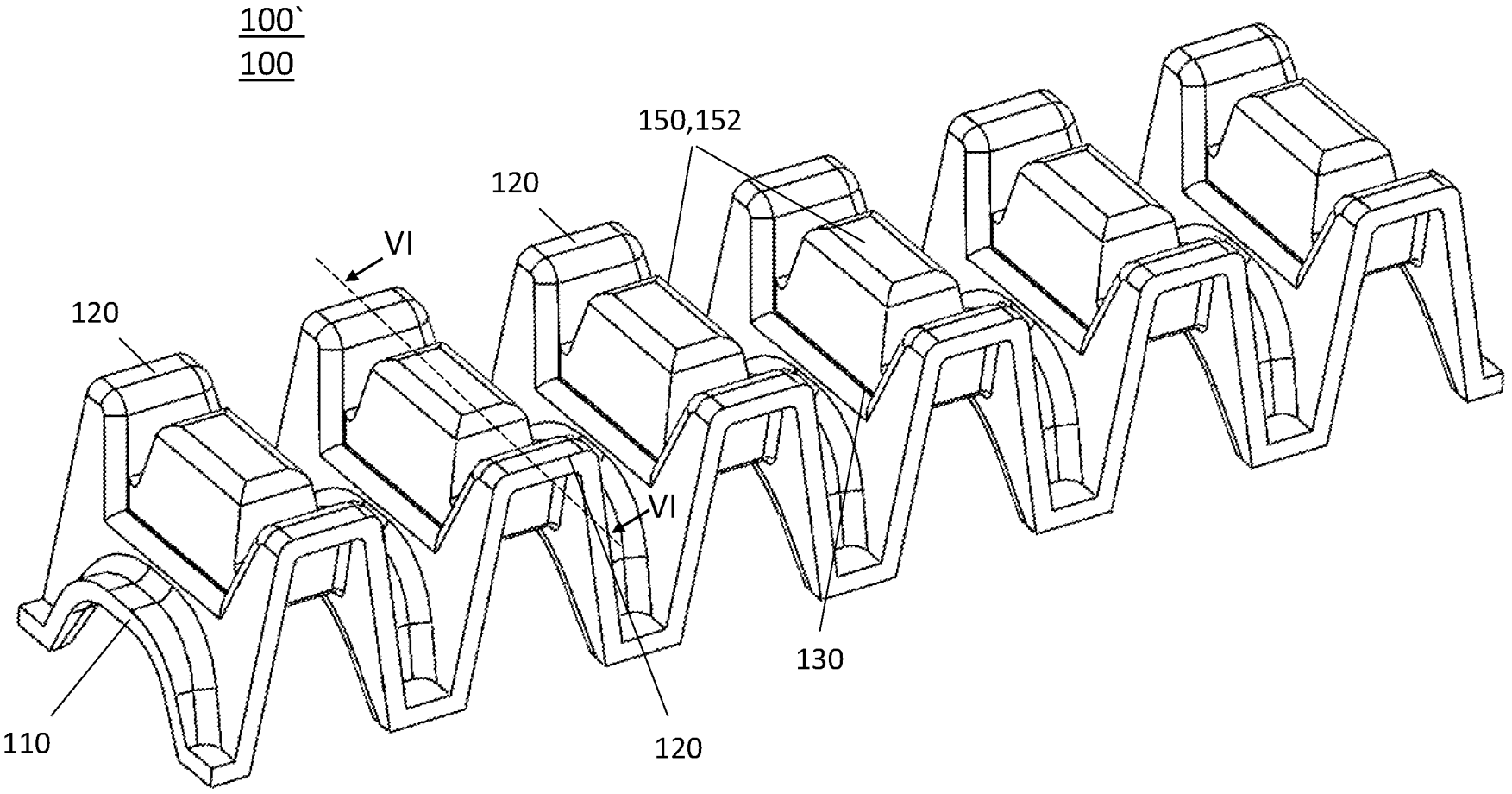
FIG. 4 is a perspective upper side, longitudinal side and front view of a second embodiment of the base member with infill members between opposing hump-shaped support members.

FIG. 4 illustrates a second exemplary embodiment for the base member 100 or the package cushioning 100', which differs from the previously shown first exemplary embodiment in that an infill member 150 can be formed above the transition 130 between the opposing support members 120. This infill member 150 typically connects the two opposing support members to one another. Alternatively or additionally, such an infill member can also be formed on the lower side of the base member between visibly opposite wall sections.

The design of the infill member 150 advantageously causes a further stiffening of the base member in a direction transverse to the longitudinal axis L. The infill members 150 are advantageously also formed as hollow bodies with the wall thickness W. At the same time, the transition 130 as the lower side of the infill member is typically also open. The infill member is typically formed in one piece with the base body and the support members with the same average wall thickness W from the same waste paper fiber material. When designed as a hollow body and in the form of a truncated pyramid, the infill members 150 enable the base member 100 to be easily stacked.

Figure 8:
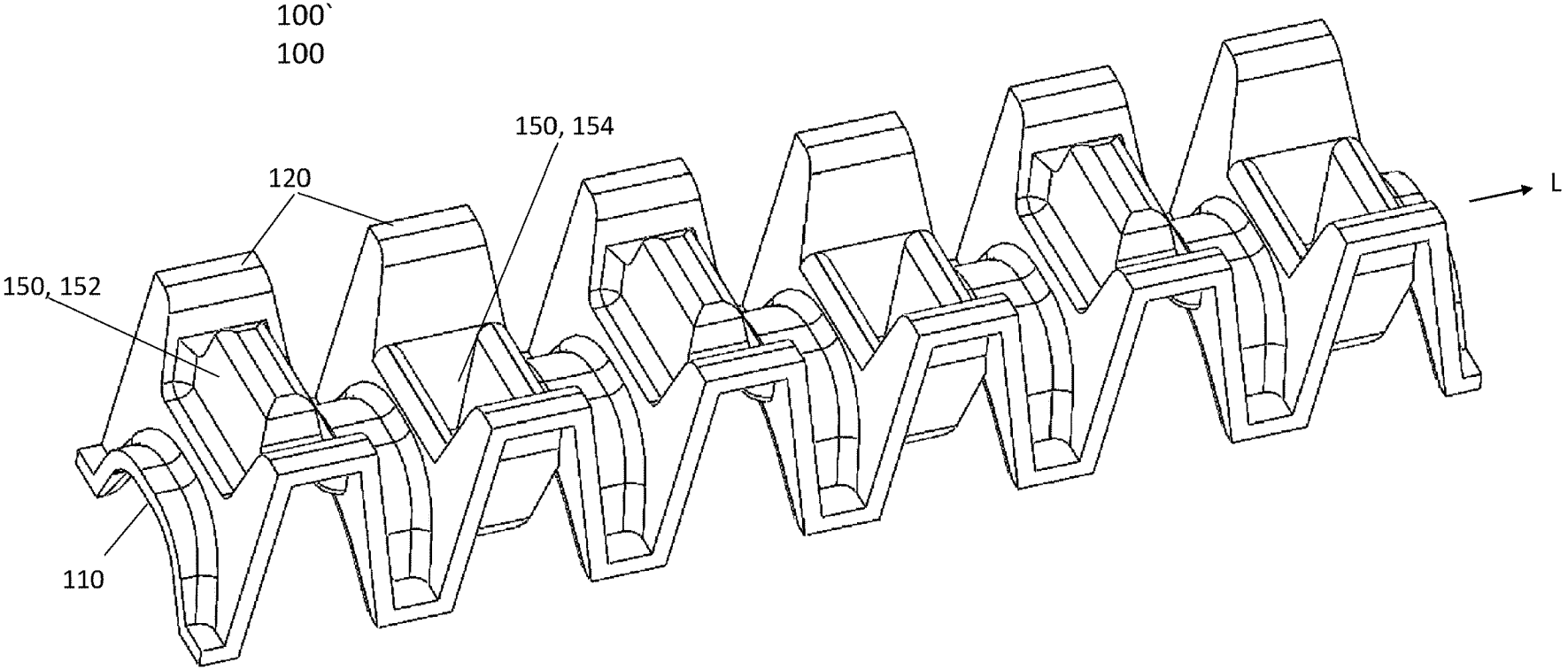
FIG. 8 shows a fourth exemplary embodiment of the package cushioning in the form of a base member, with infill members being implemented alternately in the form of a bulge and an indentation.

FIG. 4 shows the infill member 150 in the form of a bulge 152. In the form of this bulge, the infill member protrudes upwardly beyond the outside of the downwardly open half tube. Alternatively, it can also be implemented in the form of an indentation 154, as shown in FIG. 8. As an indentation, it reaches into the cavity 112 spanned by the downwardly open half tube 110. The bulges 152 and the indentations 154 can be formed alternately in the longitudinal direction L of the downwardly open half tube 110; see also FIG. 8. In contrast to what is shown in FIGS. 4 and 8, the infill member 150 can also be designed with a smooth, i.e. edge-free transition to the support members and/or the transitions 130.

The infill members 150 on the upper side of the base member 110 between the pairs of opposite support members and/or the infill member on the lower side of the base member between the pairs of opposite wall sections, not shown in the figures, can also be arranged alternately in the longitudinal direction of the base body 100.

Figure 5:
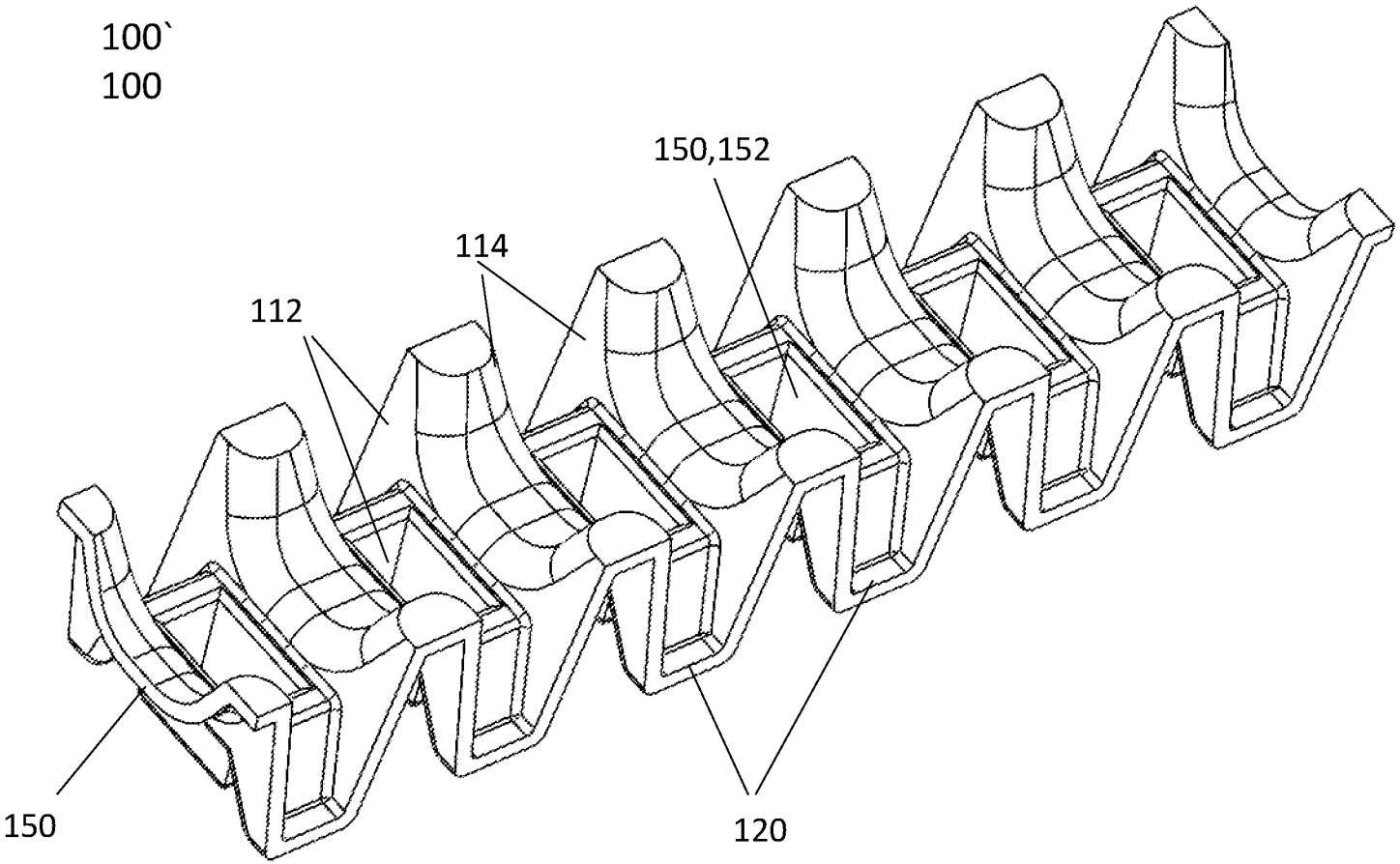
FIG. 5 is a perspective lower side view of the base member as in FIG. 4.

FIG. 5 shows a lower side view of the second exemplary embodiment of the base member 150 according to FIG. 4.

Figure 6:
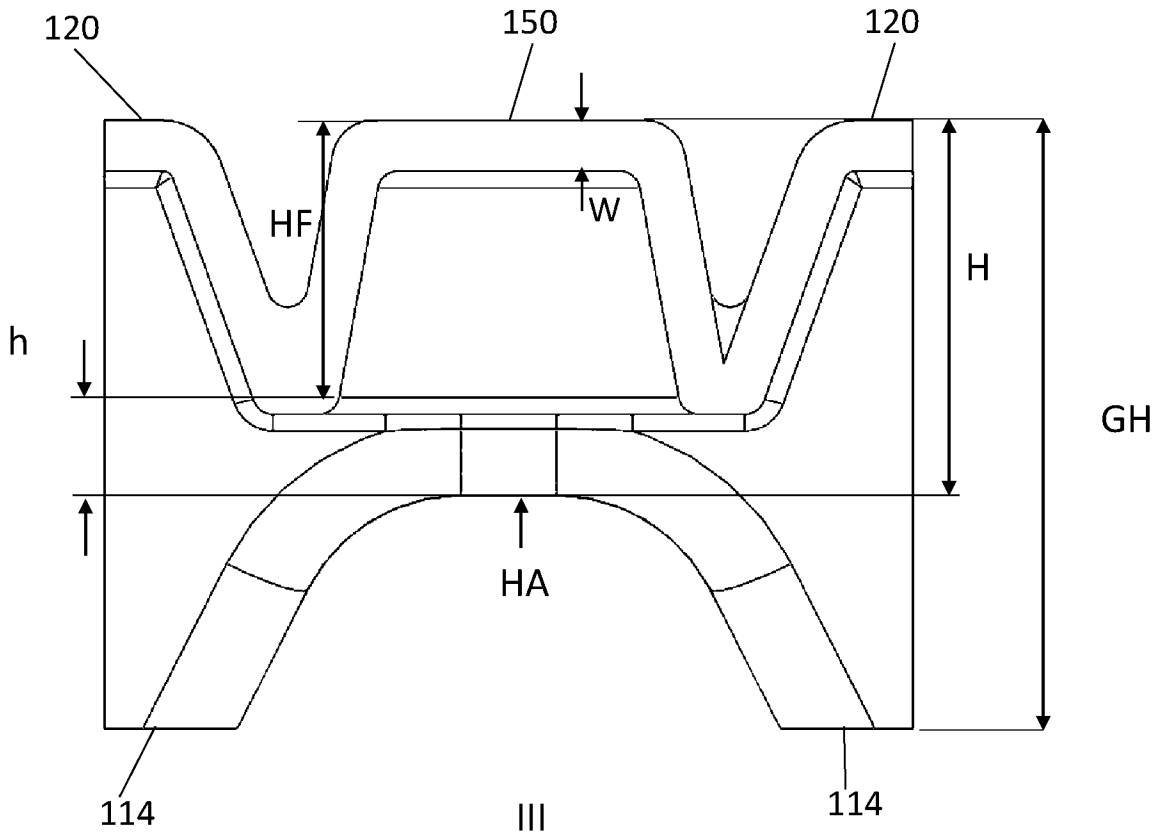
FIG. 6 shows a cross-sectional view of the second embodiment of the base member at the point VI-VI of FIG. 4.

FIG. 6 shows the base member as in FIG. 4 in a cross-sectional view, cut in plane VI-VI. The dimensions already known from FIG. 3, such as the vertical distance h between the high point H1 on the inside of the half tube 110 and the low point T on the upper side of the transitions 130, the height H of the individual support members 120 above the high points H1 and the total height GH of the base member 100 are identical for the second exemplary embodiment shown in FIGS. 4 and 6. In addition, the height HF of the infill member 150 above the transition 130 is illustrated in FIG. 6. The infill member 150 is also produced with the average wall thickness W. For the height HF, the following preferably, but not necessarily, applies: $h+HF \leq H$. That is, optionally, the infill members can protrude beyond the support members.

Figure 7:
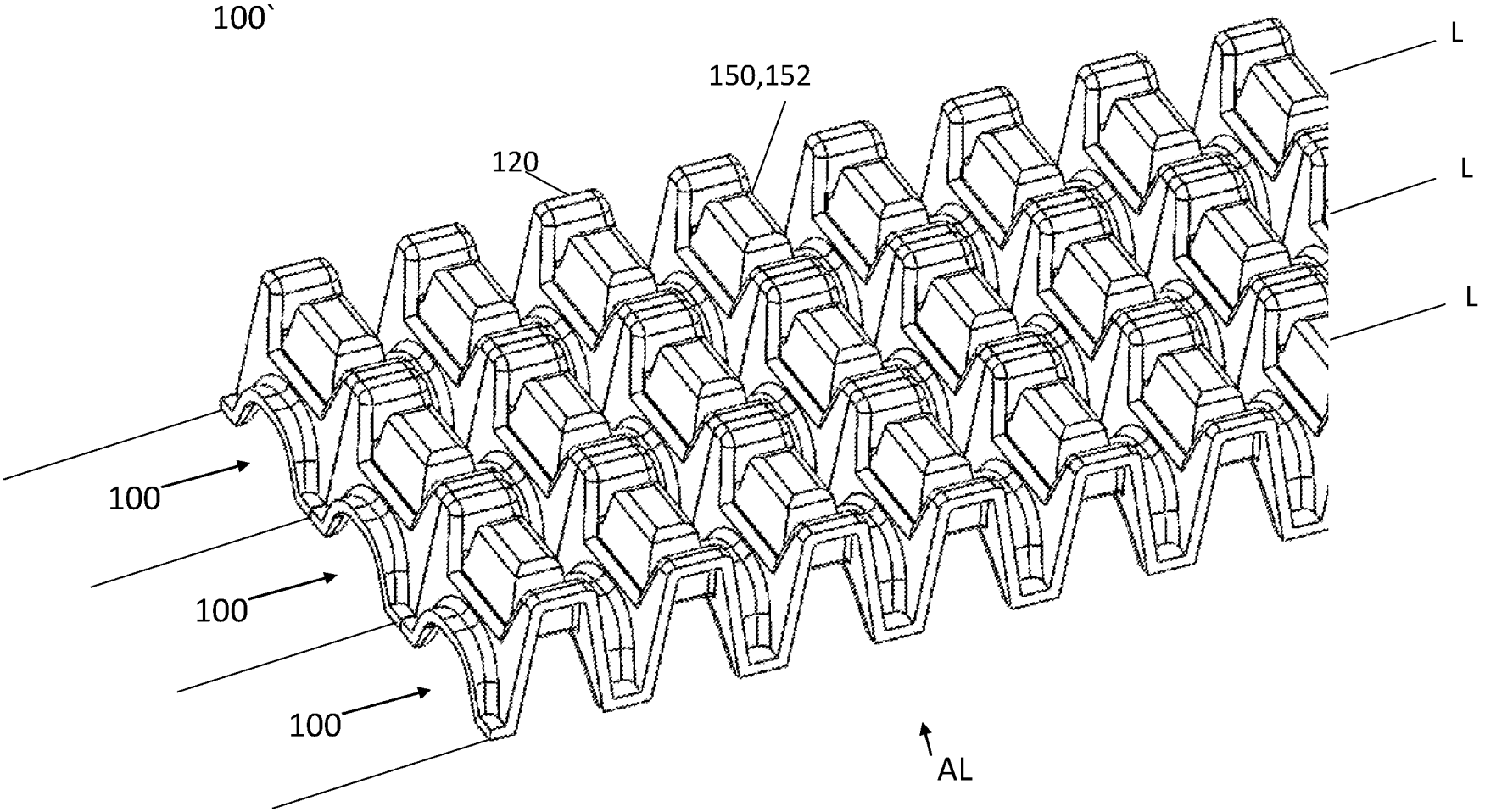
FIG. 7 shows a third embodiment of the package cushioning, with a plurality of three base members are formed parallel to one another in one piece.

FIG. 7 illustrates a third exemplary embodiment of the package cushioning 100', in which a plurality of base members 100, for example three in this case, are arranged parallel to one another. The entire package cushioning 100' is made in one piece from waste paper fiber material. The infill members 150 are here, as in the second exemplary embodiment according to FIGS. 4-6, each implemented in the form of a bulge 152, the bulge protruding beyond the outside of the downwardly open half tube. In the third exemplary embodiment shown in FIG. 7, it is also worth mentioning that the base members each stand on the floor with their downwardly open half-tubes and each abut one another with their longitudinal sides. The arrow AL drawn in FIG. 7 shows the view of the longitudinal side of one of the base members 100.

FIG. 8 illustrates a fourth exemplary embodiment of the package cushioning 100' in the form of a base member with infill members 150 between the support members 120 being implemented alternately in the form of a bulge 152 and an indentation 154. This design of the infill members also means an increase in the rigidity of the package cushioning in a direction transverse to the longitudinal axis L.

For all exemplary embodiments of the package cushioning according to the invention and the base member according to the invention, it applies that its external dimensions are preferably cut to be cuboid, as shown in FIG. 1, for example.

Figure 9:
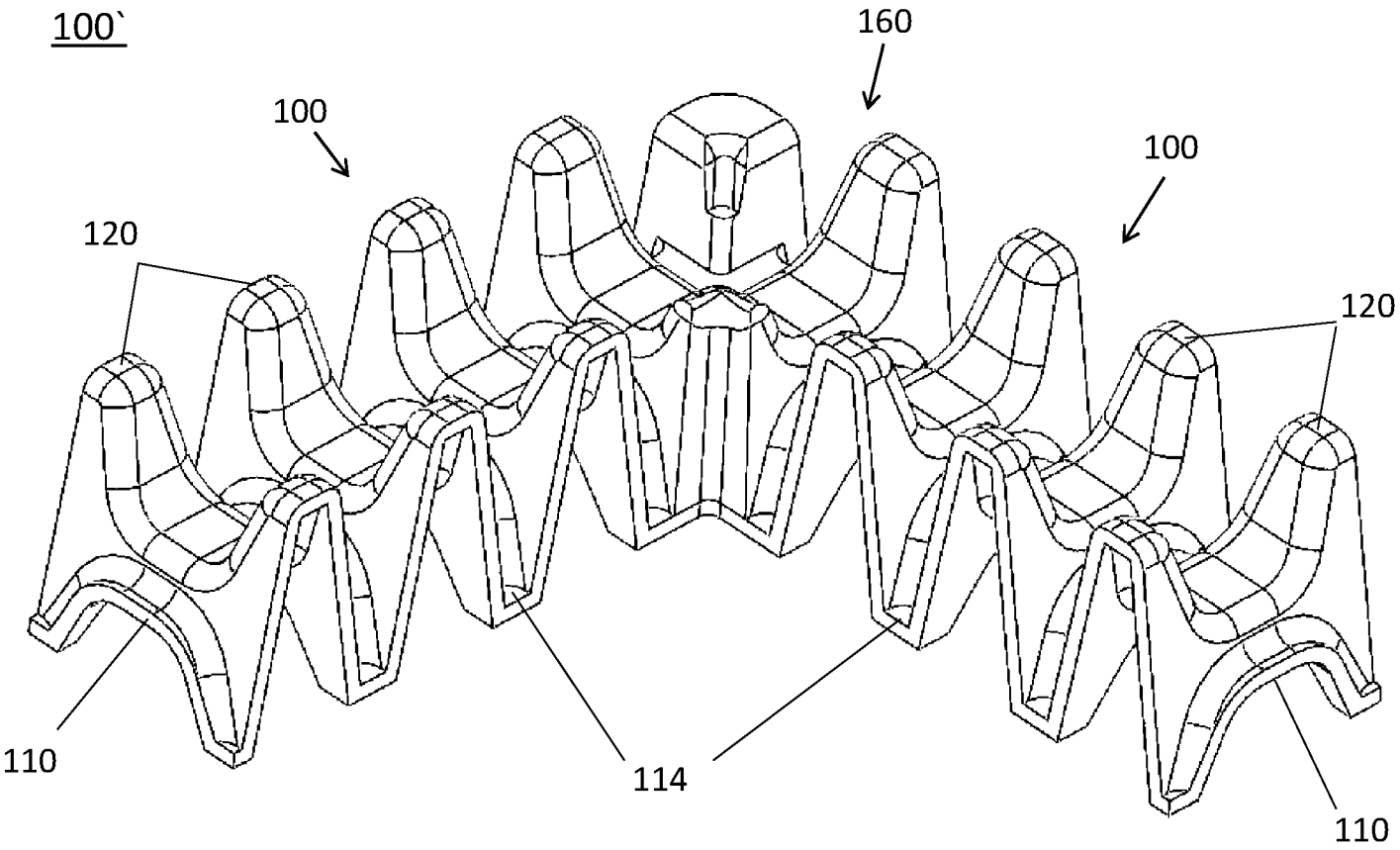
FIG. 9 shows a fifth exemplary embodiment of the package cushioning, wherein two base member are connected to one another at a predetermined angle, here for example 90°, to form a corner member.

FIG. 9 illustrates a fifth exemplary embodiment of the package cushioning 100', with two base members 100 being connected to one another at a predetermined angle, here for example 90°, to form the corner member 160. In FIG. 9, the two connected base members 100 are shown standing on their wall sections 114. Alternatively, the design of the corner member could also be realized in that the two base members 100 are connected to one another lying on their longitudinal sides. As a third alternative, it would also be possible to connect the two base members 100 on the end faces of their respective downwardly open half-tubes.

Figure 10:
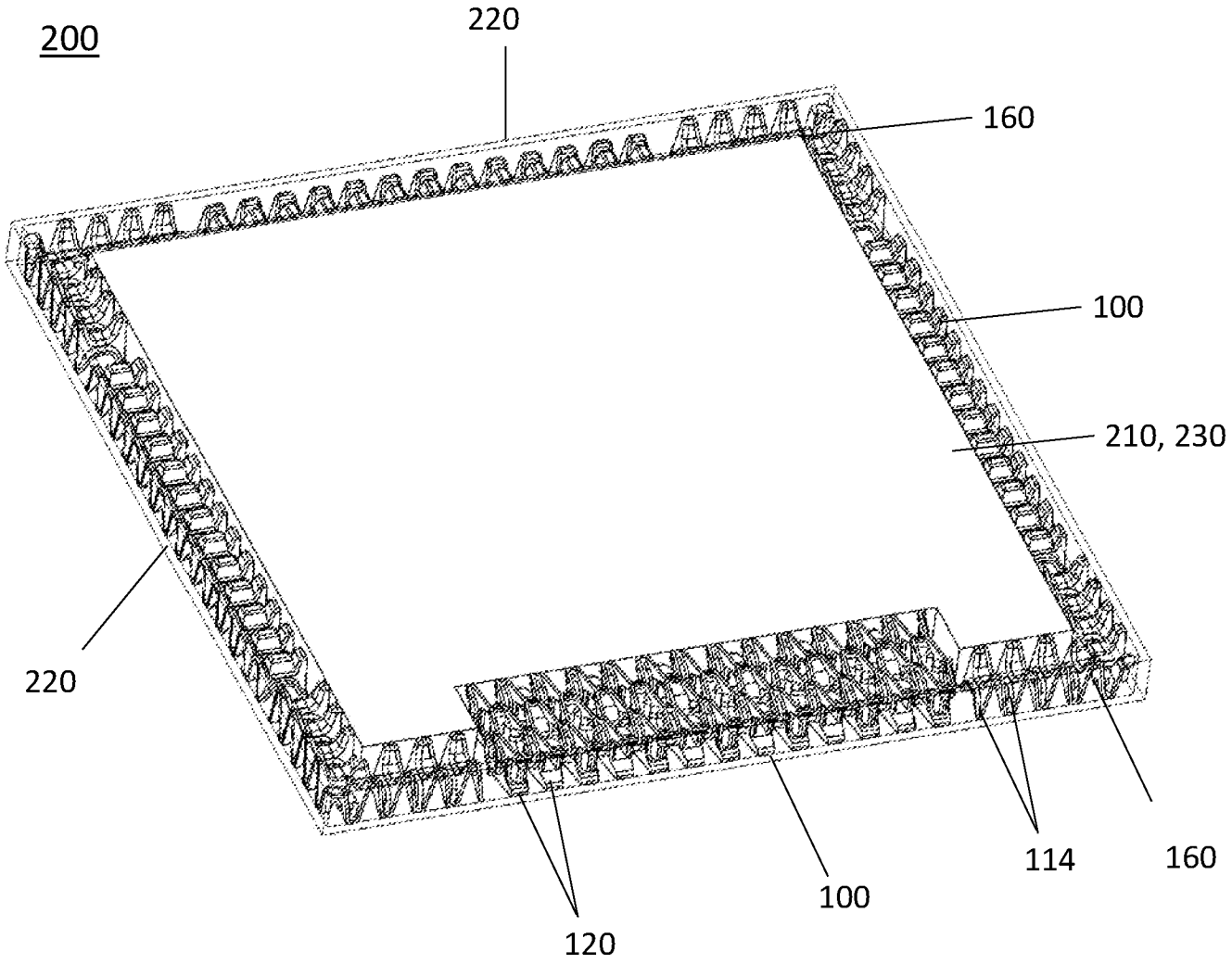
FIG. 10 shows a packaging for the article to be packaged with package cushioning applied to the inner sides of an outer box for defining and delimiting a receiving space for the article to be packaged within the outer box.

FIG. 10 illustrates a packaging 200 for a rectangular article 210, for example. The packaging has a cuboid outer box 220 and at least one package cushioning 100' inserted on its inside on its base. The package cushioning on the edges of the outer box defines and delimits a receiving space 230 for receiving the article 210 to be packaged, preferably with a precise fit, within the outer box 220. FIG. 10 shows different forms of package cushioning 100' or base members 100 being used to package the article 210. Package cushioning in the form of corner member 160 are used in the four corners of the outer box 220. On the longitudinal sides, package cushioning can be used either as a single base member or in a multiple parallel arrangement of individual base members, depending on the outline of the article to be packaged.

Figure 11:
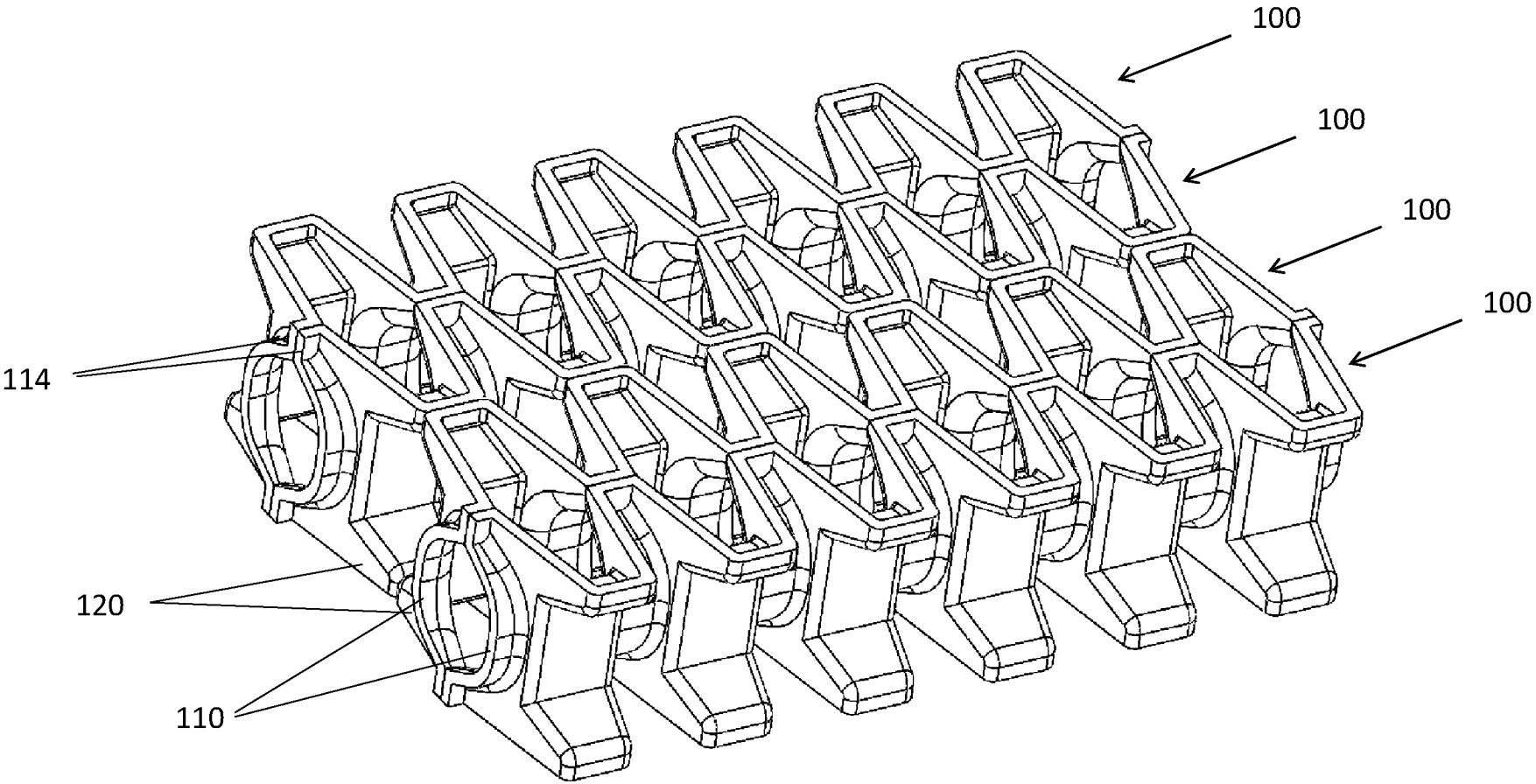
FIG. 11 shows the package cushioning in a sixth embodiment, wherein four base members are arranged parallel to one another, each standing on their support points or longitudinal sides.

The third exemplary embodiment of the package cushioning 110' is also installed in FIG. 10. Three base members with parallel longitudinal axes are connected to one another. FIG. 11 shows a modified form thereof with four parallel base members. In this sixth exemplary embodiment of the package cushioning, the base members 100 are arranged parallel to one another in each case on their longitudinal sides or on their support points. They are connected to one another either with their opposite wall members 114 or with their opposite support member 120. In this respect, it represents an alternative to the embodiment of the package cushioning 100' known from FIG. 7, in which the base members 100, which are also arranged in parallel, are connected to one another there, as stated, with their longitudinal sides facing one another.

Figure 12:
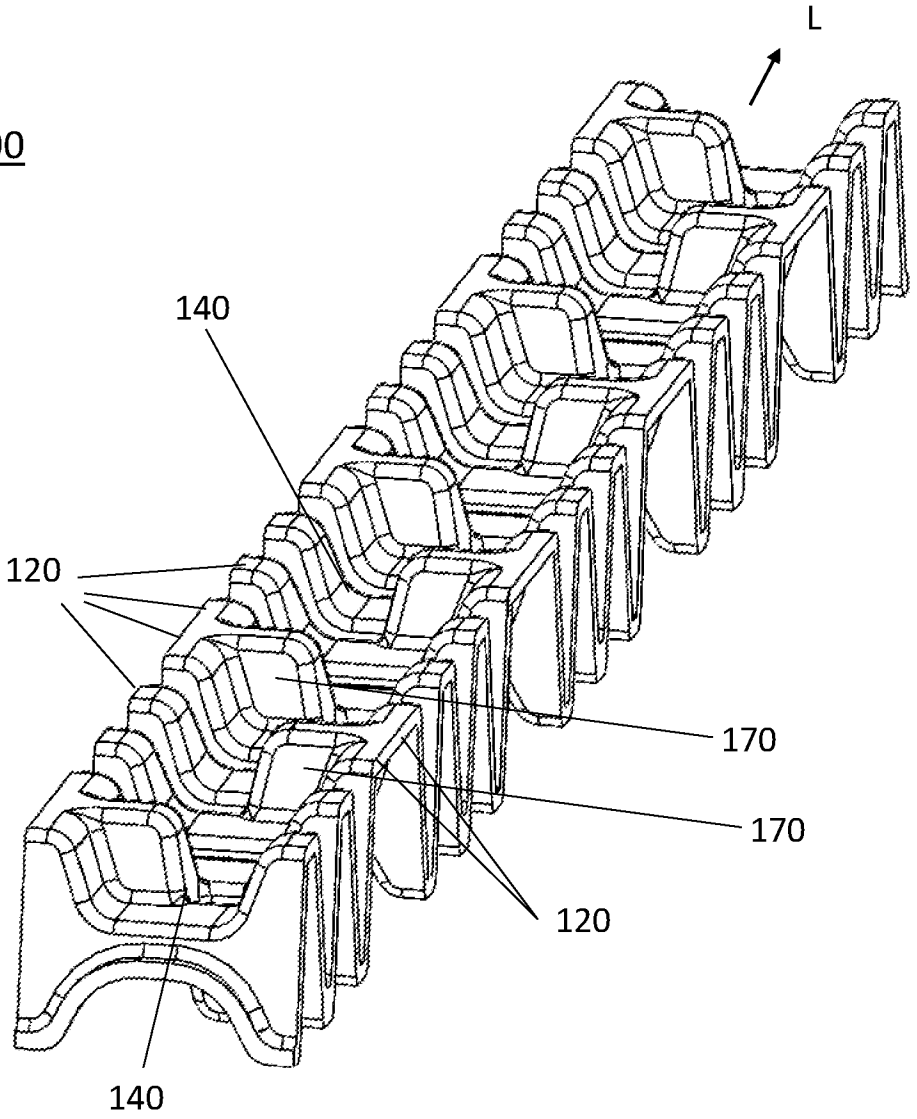
FIG. 12 shows a perspective upper side view of the package cushioning or base member in a seventh embodiment with rib member between two adjacent support members in the longitudinal direction.

FIG. 12 shows a seventh exemplary embodiment of the package cushioning 100' or base member 100, in which two adjacent support members 120 in the longitudinal direction L are connected to one another on the same side of the half tube 110 via a rib member 170, and the rib member 170 partially extends into the upwardly open channel 140. The rib members 170 are preferably formed in the longitudinal direction L of the base member 100 alternately between two left-hand and two right-hand support members 120. The terms right-hand and left-hand refer to the direction of the longitudinal axis L as shown in FIG. 12.

In this seventh exemplary embodiment of the base member, the two support members 120 together with the rib member 170 arranged between them form a cavity. The rib members 170 are also preferably designed to taper upwards, so that the base member shown in FIG. 12 can advantageously be stacked.

Figure 13:
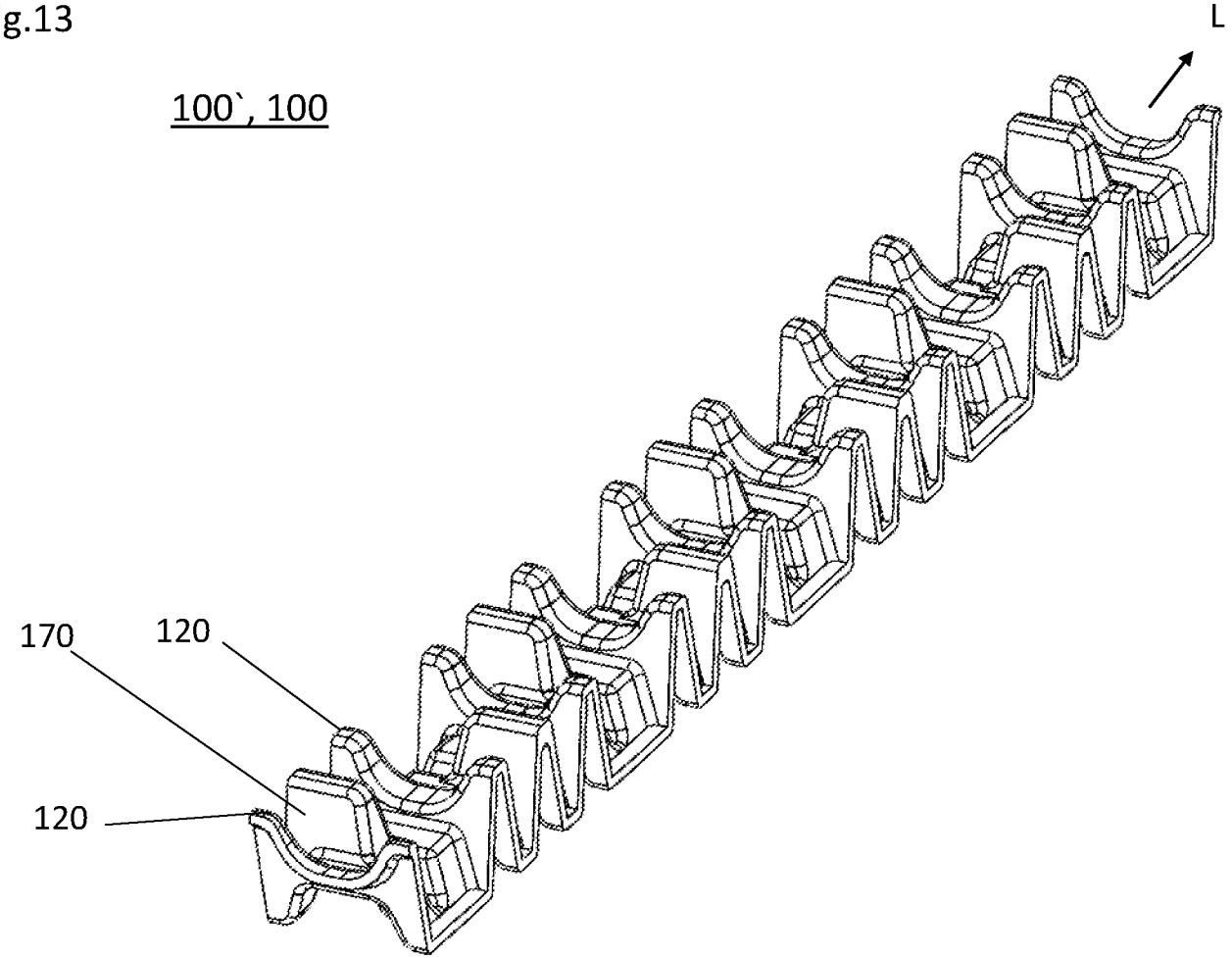
FIG. 13 shows a perspective lower side view of the seventh embodiment shown in FIG. 12.

FIG. 13 illustrates the seventh exemplary embodiment according to FIG. 12 in a perspective lower side view. Here it can be seen that wall sections 114 of the original downwardly open half tube 110 present in the first exemplary embodiments according to FIGS. 1-4 are no longer present at the locations of the rib members 170. Rather, the rib members 170 in the width direction can also be interpreted as the original wall members 114 turned up. In the seventh exemplary embodiment shown in FIGS. 12 and 13, the support members 170 extend exemplarily each only to the middle of the upwardly open channel section 140. On the lower side in the direction of the width a rib member 170' can likewise be opposite the rib member 170 that projects upwardly into the upwardly open channel section 140. This rib member 170' on the lower side typically also projects only halfway into the half tube 110 in the width direction and then transitions into the rib member 170 on the upper side. The rib members 170' can be interpreted as a special form of the configuration of the original wall section 114. The rib members 170' are preferably designed to taper downwards, so that the base member can also be stacked with these rib members 170'.

Finally, it should be mentioned that the rib members 170 on the upper side and the rib members 170' on the lower side of the base member 100 can be arranged alternately in its longitudinal direction, as shown in FIGS. 12 and 13.

Figure 14:
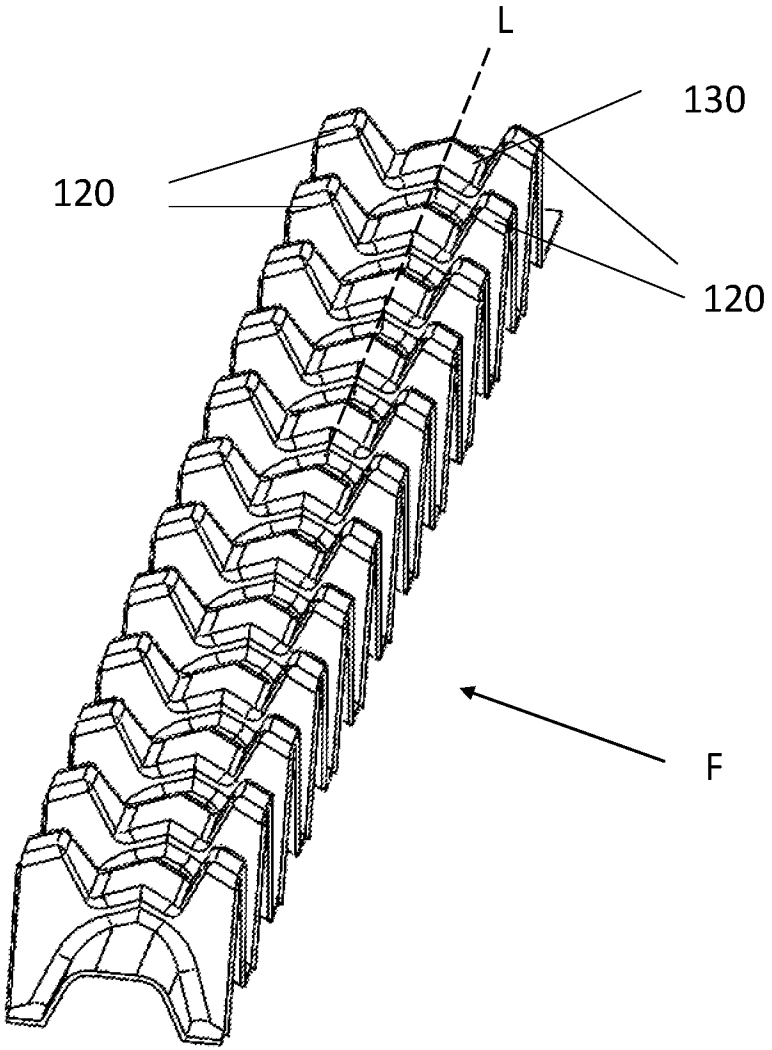
FIG. 14 shows an eighth embodiment of the package cushioning.

FIG. 14 shows an eighth exemplary embodiment of the package cushioning, in which at least some, preferably all, of the pairs of opposing support members 120 are aligned and arranged in a V-shape at an acute angle α to the longitudinal axis of the strip-shaped package cushioning. The transition regions 130 and possibly also the infill members 150 are preferably likewise V-shaped. If a plurality of support members 120 lying opposite one another in pairs are formed adjacent to one another in the longitudinal direction L on the strip-shaped package cushioning, their V-shaped orientation preferably, but not necessarily, all point in the same direction. The same also applies to the V-shaped transition areas 130 and infill members 150. Alignment in the same direction offers the advantage that the support members 120 can then be arranged more closely adjacent, for example overlapping or nested in one another.

Figure 15:
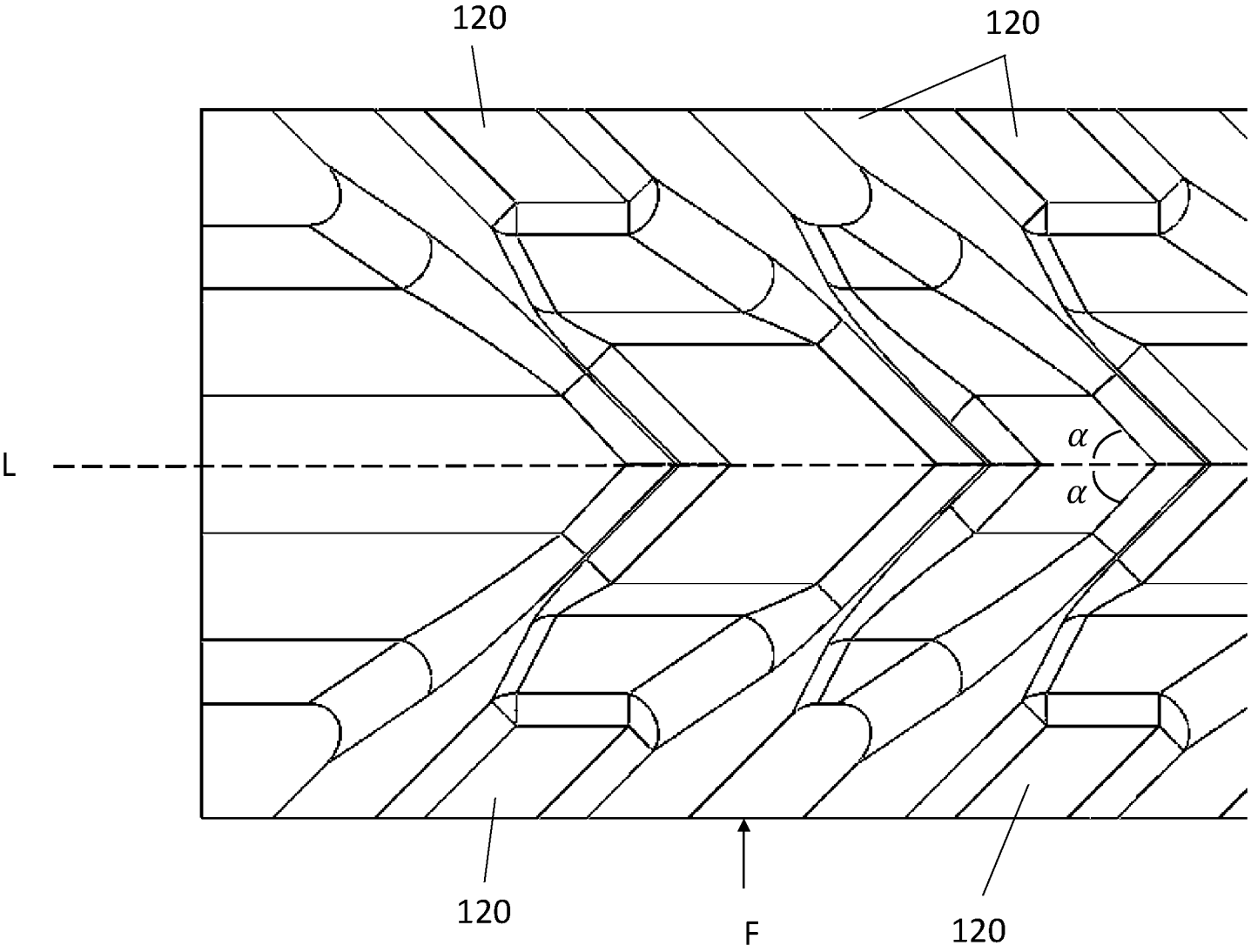
FIG. 15 shows a detailed view of FIG. 14

FIG. 15 shows the eighth exemplary embodiment of the package cushioning according to FIG. 14 in detail. Due to the V-shaped arrangement of the support members 120 and the transitions 130 and possibly also the infill members 150, an occurring force F, such as would act on the strip-shaped cushioning part transversely to its longitudinal direction, for example if the packaged article were dropped, advantageously is not directly passed through the packaged article. Instead, the V-shaped support members 120 form a predetermined crumple zone, which at least largely absorbs the acting forces due to its own deformations in the crease area and in the inner area of the package cushioning. Advantageously, no damage is then caused to the packaged article.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

REFERENCE LIST

100' package cushioning
100 base member
110 half tube
112 cavity
114 wall section
120 support member
122 surface
130 transition
140 channel section
150 infill member
152 bulge
154 indentation
160 corner member
170 rib member
170' rib member
200 packaging
210 article
220 outer box
a longitudinal distance
AB face view=front side
AL longitudinal side view
AO upper side view
AU lower side view
F application of force
GB overall width
GH overall height
GL overall length
H height of supporting member above high point H1
H1 high point of the half tube
HF height infill member above transition
h distance
L longitudinal direction, longitudinal axis
T low point
W wall thickness
α angle to the longitudinal direction

What is claimed is:

1. A package cushioning (100') for padding an article (210) to be packaged in an outer box (220) having at least one base member (100), comprising:

a base body in form of a downwardly open half tube (110); and at least two hump-shaped support members (120), which are attached to an outside of the downwardly open half tube, face each other in pairs, and protrude at an upper side of the base body with a height (H) above a high point (H1) on an inside of the downwardly open half tube (110), wherein opposing surfaces (122) of the hump-shaped support members (120) and their transition (130) on an outside of the downwardly open half tube are shaped in such a way that they jointly form an upwardly open channel section (140), and wherein the package cushioning (100') is made with an average wall thickness (W) in one piece entirely from a waste paper fiber material, and wherein a low point (T) on an inside of the upwardly open channel section (140) is spaced by a distance (h) from the high point (H1) on the inside of the downwardly open half tube (110), and wherein 1× wall thickness (W)<distance (h) applies, and wherein at least some of the support members (120) lying opposite one another in pairs are aligned and arranged in a V-shape with an acute angle (a) to a longitudinal axis (L) of the package cushioning.

2. The package cushioning (100') according to claim 1, wherein for the distance (h) the following applies: 2× wall thickness (W)≤h≤H.

3. The package cushioning (100') according to claim 1, wherein a plurality of pairs of opposing hump-shaped support members (120) are formed on the downwardly open half tube (110); and wherein the pairs of support members (120) are each arranged spaced apart from one another in a longitudinal direction (L) of the downwardly open half tube with equidistant distances (a).

4. The package cushioning (100') according to claim 1;

wherein the support members (120) are designed as hollow bodies and a wall of the downwardly open half tube (110) is open in a region of the support members, so that the downwardly open half tube and the support members span a common downwardly open cavity (112), which is delimited by remaining—unbroken—wall sections (114) of the downwardly open half tube which faces each other in pairs.

5. The package cushioning (100') according to claim 4, wherein the base member (100) has cuboid outer dimensions.

6. The package cushioning (100') according to claim 4, wherein at least some of the wall sections (114) are formed into rib member (170, 170').

7. The package cushioning (100') according to claim 6, wherein a first of the original wall sections (114) is formed into a rib member (170) projecting on the upper side of the base member into the open channel section (140), and/or wherein a second of the original wall sections (114), which is opposite the first original wall section (114)

transversely to a longitudinal direction (L), is transformed to a rib member (170') protruding into the half tube (110) on the lower side of the base member.

8. The package cushioning (100') according to claim 7, wherein the rib members (170) on the upper side and the rib members (170') on the lower side of the base member (100) alternate in its longitudinal direction (L).

9. The package cushioning (100') according to claim 1, wherein the package cushioning (100') has a plurality of the base members (100) which are integrally produced in one piece from the waste paper fiber material.

10. The package cushioning (100') according to claim 9, wherein the base members (100) are arranged at a distance from one another in such a way that longitudinal axes (L) of the base bodies of the base members run parallel to one another, and wherein longitudinal sides of two of the base members face each other or upper sides of two of the base members face each other are or lower sides of two of the base members face each other or faces of two of the base members face each other.

11. The package cushioning (100') according to claim 1, wherein the package cushioning (100') has an overall width (GB), an overall length (GL) and an overall height (GH), and wherein two of the base members (100) are connected to one another at a predetermined angle and form a corner member (160), wherein the base members connected to one another rest on their wall sections (114) with the downwardly open half tube (110), on the support members (120), or stand on one face end of the downwardly open half tube (110).

12. A packaging (200) for an article (210), comprising:

an outer box (220); and at least one package cushioning (100') according to claim 1 placed on the lower side of the outer box (220) for defining and delimiting a receiving space (230) for the article (210) to be packaged within the outer box (220).

13. The packaging according to claim 12, wherein that the package cushioning (100') has an overall width (GB), an overall length (GL) and an overall height (GH); and wherein the package cushioning (100') is placed in the outer box in such a way that the upper ends of its support members or its infill members (150) press against an edge of the article to be packaged and the lower ends of its wall sections (114) press against an inside of the outer box, or vice versa; and wherein the overall width (GB) of the package cushioning is then less than or equal to the height of the article (210) to be packaged.

14. The packaging according to claim 12, wherein that the package cushioning (100') has an overall width (GB), an overall length (GL) and an overall height (GH), and wherein the package cushioning (100') is placed in the outer box in such a way that one longitudinal side of it rests against an edge of the article to be packaged on one side of the downwardly open half tube and with its other long side on the opposite side of the downwardly open half tube presses an inside of the outer box, and wherein the overall height (GH) of the package cushioning (100') is then less than or equal to the height of the article to be packaged.

15. The packaging according to claim 12, wherein the package cushioning (100') has an overall width (GB), an overall length (GL) and an overall height (GH); and wherein the package cushioning (100') is placed in the outer box in such a way that one end of the downwardly open half tube presses against an edge of the article (210) to be packaged and the opposite end of the downwardly open half tube (110) presses against an inside of the outer box (220), and wherein the overall height (GH) of the package cushioning is then less than or equal to the height of the article (210) to be packaged.

16. A package cushioning (100') for padding an article (210) to be packaged in an outer box (220) having at least one base member (100), comprising:

a base body in form of a downwardly open half tube (110); and at least two hump-shaped support members (120), which are attached to an outside of the downwardly open half tube, face each other in pairs, and protrude at an upper side of the base body with a height (H) above a high point (H1) on an inside of the downwardly open half tube (110), wherein opposing surfaces (122) of the hump-shaped support members (120) and their transition (130) on an outside of the downwardly open half tube are shaped in such a way that they jointly form an upwardly open channel section (140), and wherein the package cushioning (100') is made with an average wall thickness (W) in one piece entirely from a waste paper fiber material, and wherein a low point (T) on an inside of the upwardly open channel section (140) is spaced by a distance (h) from the high point (H1) on the inside of the downwardly open half tube (110), and wherein 1× wall thickness (W)<distance (h) applies, and wherein the support members (120) are designed as hollow bodies and a wall of the downwardly open half tube (110) is open in a region of the support members, so that the downwardly open half tube and the support members span a common downwardly open cavity (112), which is delimited by remaining—unbroken—wall sections (114) of the downwardly open half tube which faces each other in pairs, and wherein on an underside of the base body (100) the transition between two pairs of opposite wall sections (114) is lowered, so that the high point in an area of the transition is lower than the high point on the inside of the downwardly open half tube in an area between two of the hump-shaped support members (120) that are arranged opposite in pairs.

17. A package cushioning (100') for padding an article (210) to be packaged in an outer box (220) having at least one base member (100), comprising:

a base body in form of a downwardly open half tube (110); and at least two hump-shaped support members (120), which are attached to an outside of the downwardly open half tube, face each other in pairs, and protrude at an upper side of the base body with a height (H) above a high point (H1) on an inside of the downwardly open half tube (110), wherein opposing surfaces (122) of the hump-shaped support members (120) and their transition (130) on an outside of the downwardly open half tube are shaped in such a way that they jointly form an upwardly open channel section (140), and wherein the package cushioning (100') is made with an average wall thickness (W) in one piece entirely from a waste paper fiber material, and wherein a low point (T) on an inside of the upwardly open channel section (140) is spaced by a distance (h) from the high point (H1) on the inside of the downwardly open half tube (110), and wherein 1× wall thickness (W)<distance (h) applies, and wherein the support members (120) are designed as hollow bodies and a wall of the downwardly open half tube (110) is open in a region of the support members, so that the downwardly open half tube and the support members span a common downwardly open cavity (112), which is delimited by remaining—unbroken—wall sections (114) of the downwardly open half tube which faces each other in pairs, and wherein an infill member (150) is formed at least between individual support members (120) that are in pairs opposite one another on the upper side of the base body above the transition (130) and/or between the wall sections (114) that are in pairs opposite one another on the lower side, and wherein the infill member (150) connects two opposite ones of the support members (120) and/or wall sections (114) to each other.

18. The package cushioning (100') according to claim 17, wherein the infill member (150) is designed as a hollow body, wherein the transition (130) is open as the lower side of the infill member; and wherein the infill member (150) is formed in one piece with the base body (100) and the support members (120) from the waste paper fiber material.

19. The package cushioning (100') according to claim 18, wherein the infill member (150)

is realized in the form of a bulge (152) which protrudes beyond the outside of the downwardly open half tube, or is realized in the form of an indentation (154) that reaches into of the cavity (112) spanned by the downwardly open half tube (110).

20. The package cushioning (100') according to claim 19, wherein bulges (152) and indentations (154) are formed alternately in a longitudinal direction (L) of the downwardly open half tube (110).

21. The package cushioning (100') according to claim 17, wherein infill members (150) on the upper side of the base member (110) between the pairs of opposite supporting members (120) and infill members on the lower side of the base member between pairs of opposite wall sections are arranged alternately along a longitudinal direction of the base body.

22. The package cushioning (100') according to claim 17, wherein for a height (h+HF) of the infill member (150) between two opposing support members (120) above the high point (H1) on the inside of the downwardly open half tube (110), the following applies:

$$h+HF \leq H1.$$

* * * * *